United States Patent [19]

Jacobi, Jr.

[11] Patent Number: 4,716,658

[45] Date of Patent: Jan. 5, 1988

[54] HEAT LAMP ASSEMBLY

[75] Inventor: Cecil T. Jacobi, Jr., Marshall, Mo.

[73] Assignee: Amjo Infra Red Dryers, Inc., Marshall, Mo.

[21] Appl. No.: 940,426

[22] Filed: Dec. 11, 1986

[51] Int. Cl.[4] ..... F26B 23/04

[52] U.S. Cl. ..... 34/4; 34/41; 250/495.1; 250/504 R

[58] Field of Search ..... 34/4, 41, 39, 40; 250/504 R, 495.1

[56] References Cited

U.S. PATENT DOCUMENTS

| | | | |
|---|---|---|---|
| 2,285,001 | 6/1942 | Wilson | 250/504 |
| 3,994,073 | 11/1976 | Lackore . | |
| 4,025,795 | 5/1977 | Lackore et al. . | |
| 4,146,974 | 4/1979 | Pray . | |
| 4,265,029 | 5/1981 | Jenkins . | |
| 4,297,583 | 10/1981 | Nerod . | |
| 4,336,279 | 6/1982 | Metzger . | |
| 4,434,562 | 3/1984 | Bubley et al. . | |
| 4,485,565 | 12/1984 | Ertl et al. . | |

FOREIGN PATENT DOCUMENTS

| | | | |
|---|---|---|---|
| 1581533 | 12/1980 | United Kingdom | 34/4 |

*Primary Examiner*—Larry I. Schwartz

*Attorney, Agent, or Firm*—Litman McMahon & Brown

[57] ABSTRACT

A heat lamp assembly is provided which includes a housing with a pair of quartz tube, infrared heat lamps mounted therein. A pair of reflectors partially enclose the heat lamps ad include extension legs which project downwardly from the housing and partially under the respective heat lamps. The heat lamp assembly is mounted on a printing press which includes a delivery area for a stack of printed sheets and a structure partially overhanging the delivery area. The reflector extension legs extend in an upstream direction with respect to the printing press whereby those areas of the printed sheets underneath the overhanging structure receive infrared radiation from the heat lamps.

20 Claims, 5 Drawing Figures

HEAT LAMP ASSEMBLY

BACKGROUND OF THE INVENTION

1. Field of the Invention

The present invention relates generally to a heat lamp assembly and in particular to an improved reflector for a quartz tube heat lamp assembly for drying printed materials.

2. Description of the Prior Art

Printing inks and coatings may be dried by a variety of methods which are well known in the prior art. Lower quality printing, for example newspapers and the like, is generally dried by exposure to the ambiant air and requires no supplemental drying because the paper tends to be highly absorbent. Furthermore, a certain amount of smearing and offsetting is considered acceptable in such lower quality printing. Higher quality printing, on the other hand, often requires supplemental drying because the inks and coatings tend to have relatively high moisture contents and the paper, being of a higher quality, is not nearly as absorbent as newsprint.

Drying can be supplemented by the use of anti-offset powder for absorbing the excess ink and coatings. However, the excess powder presents a maintenance problem and should not be used where it might interfere with the operation of the printing equipment.

Various types of heaters have also been employed for drying printed materials. For example, convection dryers have heretofore been employed for forcing heated air over the printed materials. Although convection drying is generally cleaner than using anti-offset powder, it tends to be relatively inefficient and may present environmental problems with disposing of the solvent-laden exhaust air. Furthermore, convection drying systems are often too large and expensive for relatively small printing presses.

Greater drying efficiency can often be achieved by using radiant heaters or heat lamps because the energy emitted thereby is largely absorbed in the liquid inks and coatings. Hence, relatively rapid evaporation can be achieved with minimal energy input by selecting heat lamps with output in the appropriate wave length range. For drying most printed materials, radiant energy in the short and medium wavelength infrared ranges (i.e. about 0.75 to 1.50 microns and 1.50 to 3.00 microns respectively) has been found to be particularly effective. Such energy is emitted by quartz tube heat lamps when they are heated to about 2400° F. Such lamps are capable of raising the temperature of printed materials to approximately 95° to 110° F., which is the optimum range for evaporating the inks and liquid coatings thereon.

Typical quartz tube heat lamp assemblies include reflectors which partially surround the quartz tubes and tube housings which include the electrical connections. For example, such a quartz tube heat lamp assembly is shown in the Jacobi et al. U.S. Pat. No. 4,501,072, which is assigned to a common assignee with the present invention.

In spite of the aforementioned advantages of quartz tube, infrared drying systems, their application to certain types of printing equipment has been limited by problems encountered in transmitting infrared energy to the printed materials. In some printing presses, access to the printed materials is substantially blocked by the press structure. The infrared radiation from conventional quartz tube heat lamp enclosures covers only a portion of the printed materials; the rest being located beneath the press structure.

Heretofore there has not been a heat lamp assembly with the advantages and features of the present invention for mounting on a printing press of the type described herein.

SUMMARY OF THE INVENTION

In the practice of the present invention, a heat lamp assembly is provided for a printing press including a delivery area for a stack of printed sheets and a structure that partially overhangs the delivery area. The heat lamp assembly includes a housing with opposite ends and a pair of tube mounting brackets each located in proximity to a respective housing end. A pair of quartz tube, infrared heat lamps extend between the housing ends and are secured by the tube mounting brackets. Each heat lamp is partially surrounded by a reflector with front, top and back legs positioned within the housing and an extension leg projecting downwardly and in an upstream direction from the housing. The reflector extension legs are located partly beneath the heat lamps and reflect radiation from the heat lamps under the overhanging structure of the printing press whereby substantially the entire areas of the printed sheets are exposed to the infrared radiation for drying.

OBJECTS OF THE INVENTION

The principal objects of the present invention are: to provide a heat lamp assembly; to provide such an assembly for drying printed materials; to provide such an assembly for a printing press with structure that overhangs printed sheets in a delivery area; to provide such an assembly with quartz tube, infrared heat lamps; to provide such an assembly with reflectors having extension legs extending downwardly and in an upstream direction; to provide such an assembly wherein the reflector extension legs reflect infrared radiation under the printing press overhanging structure; to provide such a heat lamp assembly which provides effective drying for substantially the entire areas of printed sheets; to provide such an assembly which is economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
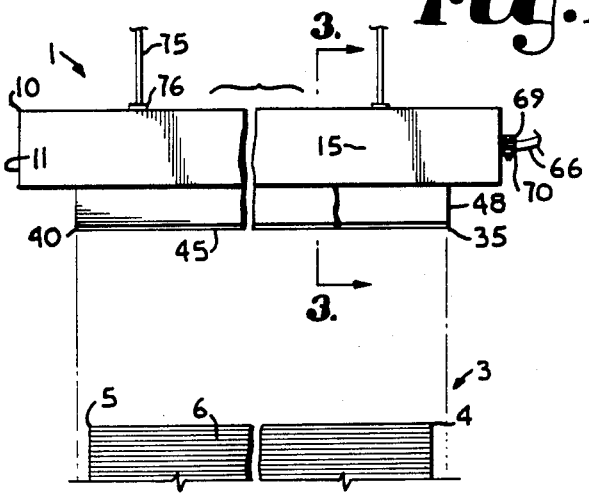
FIG. 1 is a front elevational view of a heat lamp assembly embodying the present invention and mounted on a printing press.
Figure 2:
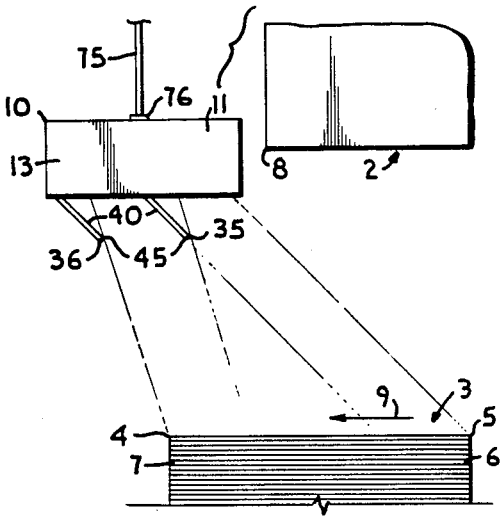
FIG. 2 is a side elevational view of the heat lamp assembly and portions of the printing press.

The directional orientations "upstream" and "downstream" refer to the right and left respectively in FIG. 2.

Referring to the drawings in more detail, the reference numeral 1 generally designates a heat lamp assembly embodying the present invention and mounted on a printer 2. The printer 2 includes a delivery area 3 for receiving a stack 4 of printed sheets 5 with upstream and downstream edges 6, 7. The printer 2 includes an overhanging structure 8 located directly over approximately two-thirds of the printed sheets 5 adjacent to their upstream edges 6. An arrow 9 indicates the direction of travel of the printed sheets 5.

The heat lamp assembly 1 includes a housing 10 with opposite ends 11 comprising a top panel 12, opposite end panels 13, 14; and front (upstream) and back (downstream) panels 15, 16. The housing 10 has an open bottom 17. Extending between the front and back panels 15, 16 in spaced relation from each end panel 13, 14 is a respective tube mounting bracket upper half 18 with a lower edge 19 and a pair of semi-circular cutouts 20 open downwardly at the lower edge 19.

A pair of cover plate clips 21 each includes a proximate leg 22 mounted vertically on the outside face of a respective tube mounting bracket upper half 18 and a distal section 23 extending at substantially right angles therefrom. A pair of housing end cover plates 25 each includes a bottom section 26 and inner and outer ends 28, 29. A tube mounting bracket lower half 30 projects upwardly from the bottom section 26 at the cover plate inner end 28 and terminates at an upper edge 31. The tube mounting bracket lower half 30 includes a pair of semi-circular cutouts 32 open upwardly at the upper edge 31 and aligned with respective tube mounting bracket upper half cutouts 20 whereby circular tube receivers 33 are formed. Respective tube mounting bracket edges 19, 31 abut each other whereby the tube mounting brackets 18, 30 are substantially coplanar. Each cover plate 25 includes a respective flange 34 projecting upwardly from its bottom section outer end and positioned against the outer face of a respective end panel 14.

Front and back reflectors 35, 36 are mounted in the housing 10 and each includes a front leg 37, a top leg 38, a back leg 39 and an extension leg 40. The front and back legs 37, 39 are substantially parallel and form dihedral angles of approximately 90° with respect to the top leg 38. The front leg 37 terminates at a free lower edge 41. The back leg 39 includes a lower edge 42 whereat it is integrally connected to the extension leg 40 along a proximate edge 43 of the latter. The back leg lower edge 42 and the extension leg proximate edge 43 define a fold line 44.

The extension leg 40 forms a dihedral angle of approximately 135° with respect to the back leg 39, or approximately 45° with respect to a plane formed by the open bottom 17 of the housing 10, and terminates at a free distal edge 45 which is located about halfway between the front and back legs 37, 39.

Figure 3:
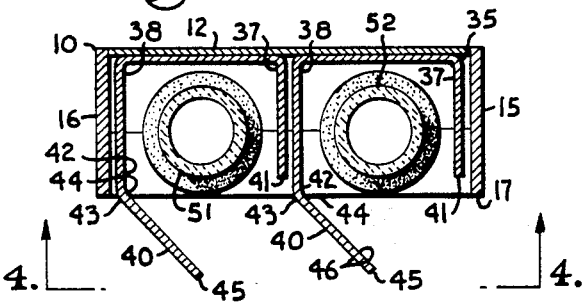
FIG. 3 is a vertical, cross-sectional view of the heat lamp assembly taken generally along line 3—3 in FIG. 1.
Figure 5:
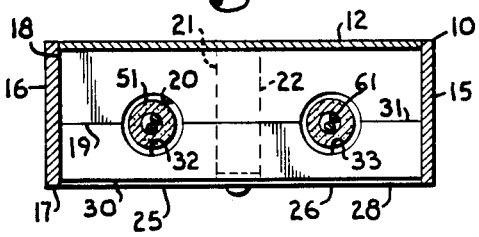
FIG. 5 is a vertical, cross-sectional view of the heat lamp assembly taken generally along line 5—5 in FIG. 4.
Figure 4:
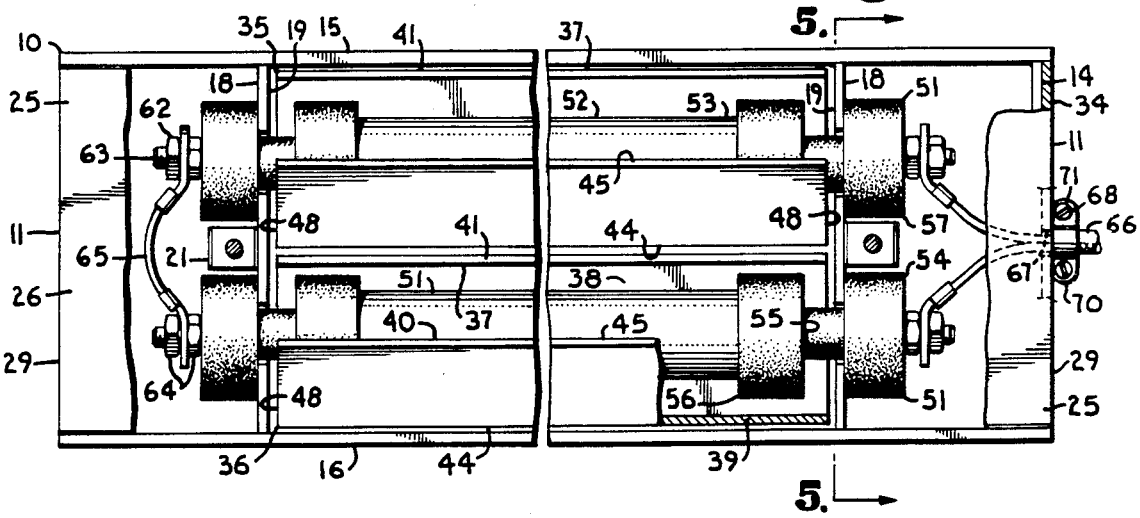
FIG. 4 is a fragmentary, bottom plan view of the heat lamp assembly as viewed generally along line 4—4 in FIG. 3.

The reflectors 35, 36 are mounted in the housing 10 as shown in FIG. 3 with their top legs 38 against the underneath side of the housing top panel 12. The front leg 37 of the front reflector 35 is located adjacent to the housing front panel 15 and the back leg 39 of the back reflector 36 is located adjacent to the housing back panel 16. The front reflector back leg 39 is located adjacent to the back reflector front leg 37. The reflectors 35, 36 include opposite ends 48 which abut respective tube mounting brackets 18, 30. The reflector front leg lower edges 41 are positioned slightly above the level of the reflector back leg lower edges 42, as shown in FIG. 3.

A pair of quartz tube, infrared heat lamps 51 are each mounted in the housing 10 and partially enclosed by a respective reflector 35, 36. Each heat lamp 51 includes a quartz tube 52 with opposite ends 53 having porcelain insulators 54 mounted thereon. Each insulator 54 is substantially cylindrical with a diameter greater than that of the quartz tube 52 and an annular groove 55 between inner and outer insulator ends 56, 57. The inner insulator ends 56 receive the quartz tube ends 53.

A nichrome resistance wire element 61 extends through each quartz tube 52 and is connected to a pair of terminals 62 each at a respective outer insulator end 57. Each terminal 62 comprises a threaded stud 63 threadably receiving a pair of clamping nuts 64. The heat lamps 51 are connected in series at respective terminals 62 at the housing end 13 by a connecting wire 65. The terminals 62 at the other housing end 14 are connected to supply lines 66 from an electrical source.

In most applications, the heat lamp assembly 1 is connected to 120 volt (r.m.s.), 60 Hz. electrical source or a 240 volt (r.m.s.), 60 Hz. electrical source, although other electrical sources could be successfully employed with the present invention. Naturally, the resistance of the nichrome wire elements 61 is chosen to yield the desired power output according to the formula wherein P=power, I=current and R=resistance:

$$P=I^2\times R$$

Preferably, the quartz tubes 52 are heated to approximately 2400° F., which produces radiant energy in the short and medium wave length infrared ranges of about 0.75 to 1.50 microns and 1.50 to 3.0 microns respectively.

The supply lines 66 extend through an opening 67 in the housing end panel 14 and are secured by a clamp 68 comprising a first clamp half 69 fixedly attached to the housing end panel 14, a second clamp half 70 and a pair of screws 71 interconnecting the clamp halves 69, 70 whereby the supply lines 66 are clamped tightly therebetween. The heat lamp assembly 1 is mounted on the press 2 by a pair of rods 75 threadably receiving mounting nuts which are attached to the housing top panel 12.

In operation, the heat lamp assembly 1 is mounted on the press 2 whereby the housing front panel 15 is in close proximity to the overhanging structure 6 and the reflector extension legs 40 extend downwardly and in an upstream direction from the housing 10. As shown in FIG. 2, the heat lamp assembly 1 is positioned approximately over the downstream edges 7 of the printed sheets 5. However, when the heat lamps 51 are energized, substantially the entire areas of the printed sheets 5 receive the energy radiated therefrom whereby the printing inks and coatings are rapidly cured and evaporated. The reflector extension legs 40 cooperate with each other and the other parts of the reflectors 35, 36 to project a substantial amount of the radiant energy output of the heat lamps 51 to the printed sheets 5.

The reflector front leg lower edges 41 are positioned above the level of the reflector back leg lower edges 42 so that they do not restrict the radiation emitted by the heat lamps 51. As shown in FIG. 3, the front leg lower edge 41 of the back reflector 36 is substantially in line with the extension leg 40 of the front reflector 35. Thus, radiation emitted by the heat lamp 51 in the back reflector 36 is reflected by the extension leg 40 of the back reflector 36 and also by the extension leg 40 of the front reflector 35, which cooperate to define a radiation emission pattern as shown in FIG. 2. More specifically, the extension leg 40 of the front reflector 35 actually reflects some of the radiation downwardly from the heat lamp 51 in the back reflector 36, while the back reflector extension leg 40 reflects the emitted radiant energy in an upstream direction.

The front reflector extension leg 40 reflects the radiant energy emitted by the heat lamp 51 in the front reflector 35 in an upstream direction. Thus, since the other reflector legs 37, 38 and 39 are also reflective, a substantial part of the energy from the heat lamps 51 is emitted from openings 46 formed between the reflector front leg lower edges 41 and the extension legs 40.

It is to be understood that while certain forms of the present invention have been illustrated and described herein, it is not to be limited to the specific forms or arrangement of parts described and shown.

What is claimed and desired to be secured by Letters Patent is as follows:

1. In combination with a printing press having a downstream delivery area for receiving sheets of printed material from an upstream area of said printing press and a structure overhanging said delivery area, the improvement of a heat lamp assembly, which comprises:

(a) a housing including:
  1. front and back sides located on upstream and downstream sides of said housing respectively;
  2. opposite ends; and
  3. a pair of tube mounting brackets each located at a respective housing end;

(b) reflector means mounted in said housing and including an upper portion and an extension leg, said extension leg being connected to said upper portion and extending downwardly and in an upstream direction therefrom;

(c) a heat lamp including opposite ends each mounted in a respective tube mounting bracket, said heat lamp being positioned between said reflector upper portion and said extension leg whereby radiation therefrom is reflected in a downward and upstream direction; and (d) mounting means for mounting said heat lamp assembly on said printing press adjacent to said overhanging structure with said extension leg projecting downwardly and in an upstream direction whereby radiation emitted by said heat lamp is reflected under said overhanging structure.

2. The heat lamp assembly according to claim 1 wherein:

(a) said housing includes top, front, back and a pair of opposite end panels; and (b) said reflector includes front, top and back legs with said reflector extension leg extending downwardly and forwardly from said reflector back leg.

3. The heat lamp assembly according to claim 1, which includes:

(a) a pair of said heat lamps; and (b) a pair of said reflectors.

4. The heat lamp assembly according to claim 1 wherein:

(a) said heat lamp comprises quartz tube with a nichrome resistance wire element.

5. The heat lamp assembly according to claim 2 wherein:

(a) said extension leg forms an angle of approximately 135° with respect to said back leg.

6. The heat lamp assembly according to claim 2 wherein:

(a) said reflector back leg terminates at a lower edge contiguous with said extension leg and said front leg terminates at a lower edge positioned at a level above said back leg lower edge.

7. In combination with a printing press having a downstream delivery area for receiving sheets of printed material from an upstream area of said printing press and a structure overhanging said delivery area, the improvement of a heat lamp assembly, which comprises:

(a) a housing including:
  (1) front and back sides located on upstream and downstream sides of said housing respectively;
  (2) opposite ends; and
  (3) a pair of tube mounting brackets each having a pair of receivers and extending between said front and back housing sides at a respective housing end;

(b) front and back reflector means each including an upper portion and an extension leg connected thereto, said extension leg extending downwardly and in an upstream direction from said upper portion;

(c) a pair of heat lamps each including:
  (1) a quartz tube with opposite ends;
  (2) a pair of insulators each receiving a respective quartz tube opposite end and received in a respective tube mounting bracket receiver whereby said heat lamp extends between said housing ends;
  (3) a resistance element extending through said quartz tube;
  (4) a pair of electrical terminals each located at a respective insulator and connected to said element; and
  (5) said quartz tube being positioned between said reflector upper portion and extension leg whereby radiation therefrom is reflected in a downward and upstream direction; and (d) mounting means for mounting said heat lamp assembly on said printing press adjacent to said overhanging structure with said extension legs projecting downwardly and in an upstream direction whereby radiation emitted by said heat lamps is reflected under said overhanging structure.

8. The heat lamp assembly according to claim 7, which includes:

(a) said terminals at one end of said housing being electrically connected; and (b) said terminals at the other end of said housing being connected to a power line whereby said heat lamps are connected in series.

9. The heat lamp assembly according to claim 7 wherein:

(a) said housing includes top, front, back and a pair of opposite end panels.

10. The heat lamp assembly according to claim 7 wherein:

(a) each reflector upper portion includes front, top and back legs; and (b) said reflector extension leg extends downwardly and in an upstream direction from said reflector back leg.

11. The heat lamp asssembly according to claim 10 wherein:

(a) each said reflector back leg terminates at a lower edge; and (b) each said reflector extension leg includes a proximate edge connected to a respective reflector back leg lower edge and a distal free edge approximately centered below a respective quartz tube.

12. The heat lamp assembly according to claim 11 wherein:

(a) each said reflector front leg terminates at a lower free edge located above the level of said reflector back leg lower edge.

13. The heat lamp assembly according to claim 10 wherein:

(a) each said reflector extension leg forms an angle of approximately 135° with respect to a respective reflector back leg.

14. The heat lamp assembly according to claim 11 wherein:

(a) said extension leg of said front reflector, said front leg lower edge of said back reflector and said quartz tube of said back reflector are substantially aligned.

15. The heat lamp assembly according to claim 7 wherein:

(a) said heat lamps emit radiation in the infrared range.

16. The heat lamp assembly according to claim 7, which includes:

(a) a pair of cover plates each mounted on a respective end of said housing and including a bottom section and a lower half of said tube mounting bracket extending from said bottom section; and (b) each said tube mounting bracket including an upper half.

17. The heat lamp assembly according to claim 16 wherein:

(a) each said tube mounting bracket half includes an edge and a pair of semi-circular cutouts open at said edge; and (b) associated pairs of said semi-circular cutouts being positioned in opposed relation with said cover plates mounted on said housing ends whereby circular receivers are formed.

18. The heat lamp assembly according to claim 16, which includes:

(a) a pair of cover mounting clips each attached to a respective tube mounting bracket upper half and a respective cover plate.

19. The heat lamp assembly according to claim 7 wherein:

(a) each said reflector is formed from sheet metal which is reflective on both sides.

20. In combination with a printing press having a downstream delivery area for receiving sheets of printed material from an upstream area of said printing press and an overhanging structure located above said delivery area, the improvement of a heat lamp assembly which comprises:

(a) a housing including:

(1) a top panel;

(2) opposite end panels;

(3) a front panel;

(4) a back panel;

(5) an open bottom;

(6) a pair of tube mounting bracket lower halves extending between said front and back panels in spaced relation from respective end panels and each including a lower edge and a pair of semicircular cutouts open downwardly at said lower edge;

(7) a pair of cover plate clips each including a vertical proximate section mounted on a respective tube mounting bracket upper half and a horizontal distal section extending outwardly from said tube mounting bracket upper half;

(8) a pair of cover plates each including inner and outer ends, a tube mounting bracket lower half extending upwardly from said inner end and having an upper edge and a pair of semicircular cutouts open upwardly at said upper edge and a flange projecting upwardly from said cover plate outer end; and (9) said cover plate bottom section being attached to said cover plate clip distal section by a screw extending therethrough whereby said cutouts of said tube mounting bracket upper and lower halves are aligned to define circular tube receivers and said flanges are positioned outside of respective housing end panels;

(b) front and back reflectors each having:

(1) a vertical front leg terminating in a free lower edge;

(2) a top leg;

(3) a back leg terminating in a lower edge;

(4) an extension leg having a proximate edge integrally connected to said back leg lower edge and defining a fold line thereat and a free proximate edge, said extension leg forming a dihedral angle approximately 135° with respect to said back leg;

(5) said front leg lower edge being positioned below a level of said front leg lower edge; and (6) opposite ends abutting said tube mounting brackets;

(7) said front reflector front leg being positioned adjacent to said housing front panel and said back reflector back leg being positioned adjacent to said housing back panel; and (8) said reflector top legs being positioned adjacent to said housing top panel;

(c) a pair of heat lamps each including:

(1) a quartz tube with opposite ends;

(2) a pair of porcelain insulators each having a diameter greater than said quartz tube and inner and outer ends with an annular groove therebetween, said inner insulator end receiving a respective quartz tube end and said annular groove being received in a respective tube receiver whereby said tube extends between said tube mounting brackets and is partially enclosed by a respective reflector;

(3) a nichrome wire element extending through said quartz tube;

(4) a pair of terminals each located at a respective outer insulator end and connected to said element; and (5) a pair of said terminals at adjacent ends of said heat lamps being electrically connected and a pair of terminals at the other adjacent ends of said heat lamps being connected to a power source whereby said heat lamps are connected in series;

(d) one of said housing end panels having an opening with said power line extending therethrough;

(f) a cable clamp positioned adjacent to said housing end panel opening for clamping said power supply lines; and (g) mounting means for mounting said heat lamp assembly on said printing press adjacent to said overhanging structure with said extensions projecting downwardly and in an upstream direction from said housing whereby radiation emitted by said heat lamps is reflected under said overhanging structure and into said printed sheet delivery area.

* * * * *